US008851789B2

(12) United States Patent
Bax

(10) Patent No.: US 8,851,789 B2
(45) Date of Patent: Oct. 7, 2014

(54) SYSTEMS AND METHODS FOR VENTING GAS IN THE EVENT OF AN EXPLOSION IN A SPACE COVERED BY A MANHOLE COVER

(75) Inventor: Daniel D. Bax, St. Louis, MO (US)

(73) Assignee: Ameren Corporation, St. Louis, MO (US)

( * ) Notice: Subject to any disclaimer, the term of this patent is extended or adjusted under 35 U.S.C. 154(b) by 0 days.

(21) Appl. No.: 13/270,922

(22) Filed: Oct. 11, 2011

(65) Prior Publication Data

US 2013/0089373 A1 Apr. 11, 2013

(51) Int. Cl.
*E02D 29/14* (2006.01)

(52) U.S. Cl.
CPC ..... *E02D 29/14* (2013.01)
USPC ..... 404/25; 52/20

(58) Field of Classification Search
USPC ..... 404/25, 26; 137/371; 52/20
See application file for complete search history.

(56) References Cited

U.S. PATENT DOCUMENTS

| | | | | | |
|---|---|---|---|---|---|
| 4,486,122 | A * | 12/1984 | Arntyr et al. | 405/157 |
| 4,514,931 | A * | 5/1985 | Beck et al. | 49/21 |
| 5,028,320 | A * | 7/1991 | Gaudin et al. | 210/164 |
| 5,062,735 | A * | 11/1991 | Gaudin | 404/25 |
| 5,511,575 | A * | 4/1996 | Andenmatten et al. | 137/43 |
| 5,611,640 | A * | 3/1997 | Bowman | 404/4 |
| 6,350,081 | B1 | 2/2002 | Khajavi | |
| 6,402,423 | B1 * | 6/2002 | Stellmach | 404/26 |
| 6,551,015 | B1 * | 4/2003 | Khajavi et al. | 404/25 |
| 6,688,806 | B2 * | 2/2004 | Kuan | 404/25 |
| 7,484,908 | B2 | 2/2009 | Stadler | |
| 7,712,995 | B2 | 5/2010 | Stadler | |
| 7,891,904 | B2 | 2/2011 | Stadler | |
| D669,969 | S * | 10/2012 | Forrest et al. | D23/261 |
| 8,714,867 | B1 * | 5/2014 | Vrondran et al. | 404/25 |

FOREIGN PATENT DOCUMENTS

| | | |
|---|---|---|
| KR | 2020080006648 | 12/2008 |
| KR | 1020090003796 A | 1/2009 |

OTHER PUBLICATIONS

International Search Report regarding corresponding PCT/US2012/059779, dated Mar. 28, 2013, 2 pages.
Written Opinion of the International Searching Authority regarding corresponding PCT/US2012/059779, dated Mar. 28, 2013, 9 pages.
International Preliminary Report on Patentability regarding corresponding PCT/US2012/059779, dated Apr. 24, 2014, 11 pages.

* cited by examiner

*Primary Examiner* — Gary Hartmann
(74) *Attorney, Agent, or Firm* — Senniger Powers LLP

(57) ABSTRACT

A closure is adapted to limit damage from a gas explosion in an underground space. The closure includes a telescoping sleeve having a plurality of vents extending radially through the sleeve. The sleeve defines a manhole extending axially through the sleeve so a person can enter the underground space through the manhole. A manhole cover is moveable to a closed position in which the cover is supported on an upper end of the sleeve and covers the manhole. The sleeve can be received in an opening of a frame of a manhole installation so the sleeve is moveable by gas pressure to an extended position in which gas from the underground space can be vented through the sleeve to an aboveground space. If desired, the sleeve can be installed in an existing manhole installation to upgrade the installation to have an explosion mitigation capability without replacing the conventional manhole cover.

22 Claims, 16 Drawing Sheets

101

101

SYSTEMS AND METHODS FOR VENTING GAS IN THE EVENT OF AN EXPLOSION IN A SPACE COVERED BY A MANHOLE COVER

FIELD OF INVENTION

The present invention is generally related to systems and methods for venting gas from an underground space in the event of an explosion, and more particularly to systems and methods for providing access to an underground space through a manhole and limiting damage that could result in the event explosive gas that may accumulate in the underground space is unintentionally ignited.

BACKGROUND

Manholes are used to access various underground spaces. For example, underground electrical distribution lines are sometimes formed by splicing segments of insulated electrically conductive lines together. It is conventional to leave at least the joint formed by splicing multiple segments together in a relatively exposed condition in an underground space and to install a manhole so maintenance or repair workers can access the underground space to do maintenance or repair work. Faults in the electrical distribution line in the underground space can generate combustible gas, which can sometimes be ignited by sparks from the faulty electrical distribution line or other ignition sources. In the event combustible gas accumulates in the underground space and is ignited, an explosion may result. One of the dangers presented by any such explosion is that it could blow the manhole cover into the air. Because manhole covers typically weigh several hundred pounds, there is potential for injury or death to people and/or significant property damage from the manhole cover in the event of an explosion.

U.S. Pat. No. 7,712,995 (Stadler) discloses a method of controllably venting gases generated by an explosion in a manhole space. Stadler's solution is to use a specially formed manhole cover having a lug 24 and lock 20 formed on the underside of the manhole. The lug and lock are positioned on opposite sides of the manhole cover at its perimeter. A skirt 66 extends down from the bottom of the manhole cover and has a plurality of openings 68 spaced circumferentially around the perimeter of the manhole cover. In the event of an explosion, the manhole cover is lifted off the frame of the manhole to allow gas to be vented between the manhole cover and frame. In the first stage of an explosion, the manhole cover is lifted by the gas pressure until the lug and lock catch on an annular shoulder 18 extending inward from the manhole frame. If the venting provided at this first stage is insufficient, the pressure from the gas breaks a shear pin 32 in the lock which allows the side of the manhole cover on which the lock is positioned to rise further off the frame to allow additional venting.

In order to access the space covered by Stadler's manhole cover, workers use a tool to retract a latching member 26 of the lock. Even with the latching member retracted, the lug 24 prevents the manhole cover from being lifted straight off the frame. However, workers are able to remove the unlocked manhole cover and enter the space below by lifting the side of the manhole on which the lock is positioned. The lug prevents the other side of the manhole from being lifted more than a short distance off the frame, but once the side of the manhole cover on which the lock is positioned is lifted high enough, the lug can be disengaged from the shoulder and the cover can be removed by pulling the manhole cover away from the portion of the shoulder engaged by the lug.

The present inventor has discovered improved systems and methods for venting gas from an underground space covered by a manhole cover, which will be described in detail below.

SUMMARY

One aspect of the invention is a system for providing access to an underground space and limiting damage caused by combustion of an explosive gas that might accumulate in the underground space. The system includes a frame enclosing at least a portion of the underground space. The frame has a frame opening. A sleeve is received in the frame opening. The sleeve has a manhole extending therethrough for providing access to the underground space so a person can enter the underground space from above through the manhole. A manhole cover is moveable relative to the sleeve and is adapted to be moved to a closed position in which the manhole cover covers the manhole to limit access to the underground space through the manhole while the manhole cover is in the closed position. The sleeve includes a pressure relief system adapted to vent gas from the underground space to an above ground environment in the event the explosive gas that might accumulate in the underground space is ignited.

Another aspect of the invention is a closure for an underground space. The closure is adapted to limit damage caused by combustion of one or more explosive gases that might accumulate in the underground space. The closure includes a substantially cylindrical sleeve having a plurality of vents extending radially through the sleeve. The sleeve defines a manhole extending axially through the sleeve for providing access to the underground space so a person can enter the underground space through the manhole. A manhole cover is moveable relative to the sleeve and adapted to be moved to a closed position in which the manhole cover is supported an upper end of the sleeve and covers the manhole to limit access to the underground space through the manhole while the manhole cover is in the closed position.

Yet another aspect of the invention is a method of modifying an existing manhole installation to provide an explosion mitigation feature. The manhole installation is positioned above an underground space and includes a frame defining a manhole opening for accessing the underground space from above and a manhole cover movable between a closed position in which the manhole cover covers the manhole opening and an open position in which the manhole cover does not cover the manhole opening. The method includes installing a telescoping sleeve in the manhole installation. The sleeve has a plurality of vents extending radially through the sleeve. The sleeve is moveable from a retracted position to an extended position in response to a force exerted by pressurized gas in the underground space during an explosion. The vents are positioned to allow gas to escape the underground space through the vents when the sleeve is in the extended position. The method also includes placing a manhole cover over an opening defined by the sleeve and using one or more locks to lock the manhole cover to the sleeve.

Other objects and features of the invention will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
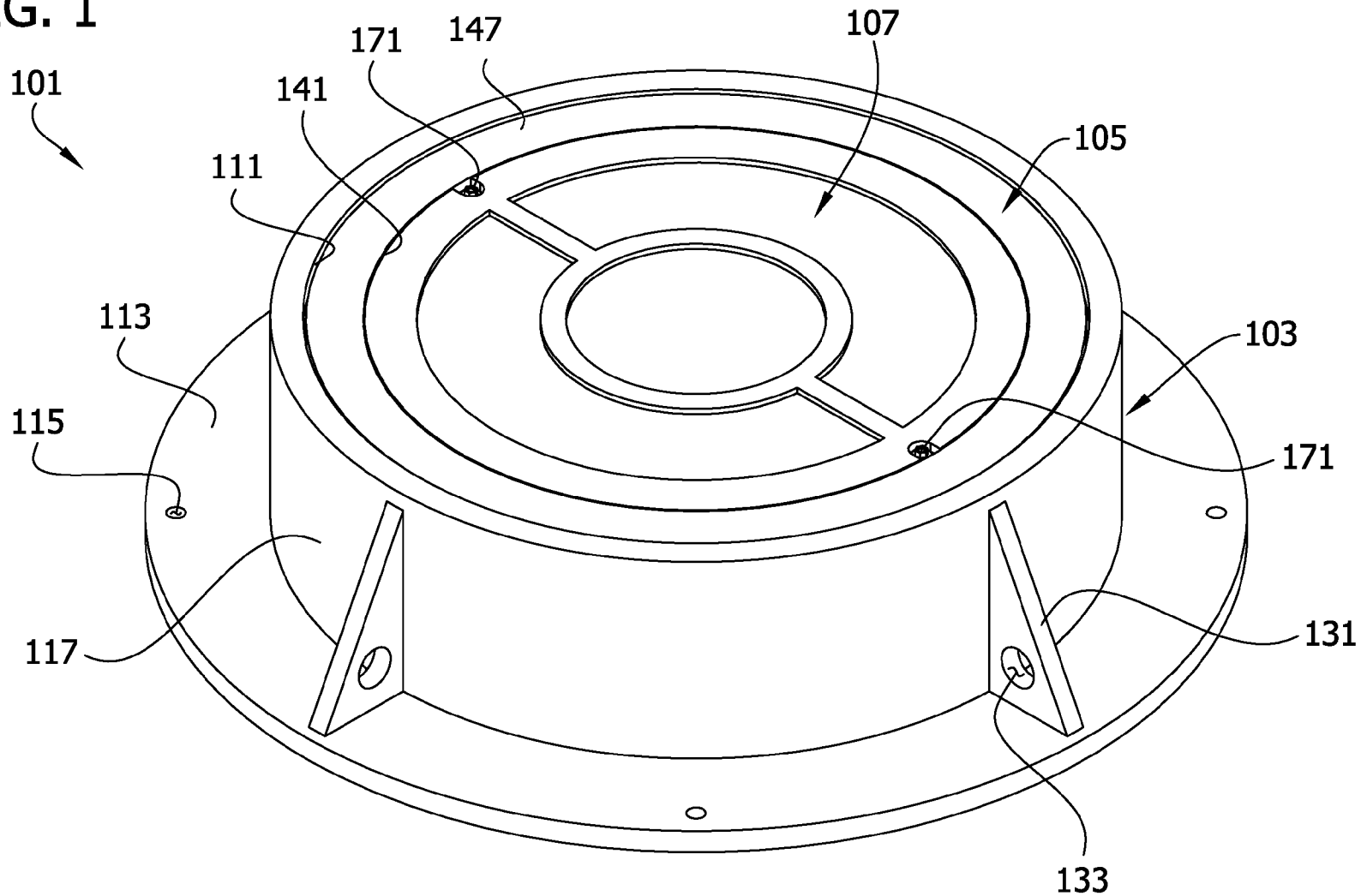
FIG. 1 is a perspective of one embodiment of a manhole closure of the present invention.

Referring now to the drawings, first to FIGS. 1-7, one embodiment of a closure for an underground space is generally designated 101. As will be explained in more detail below, the closure 101 is adapted to limit damage caused by combustion of one or more explosive gases that might be accidentally ignited after accumulating in the underground space. The closure 101 includes a frame 103, a sleeve 105, and a manhole cover 107.

Figure 2:
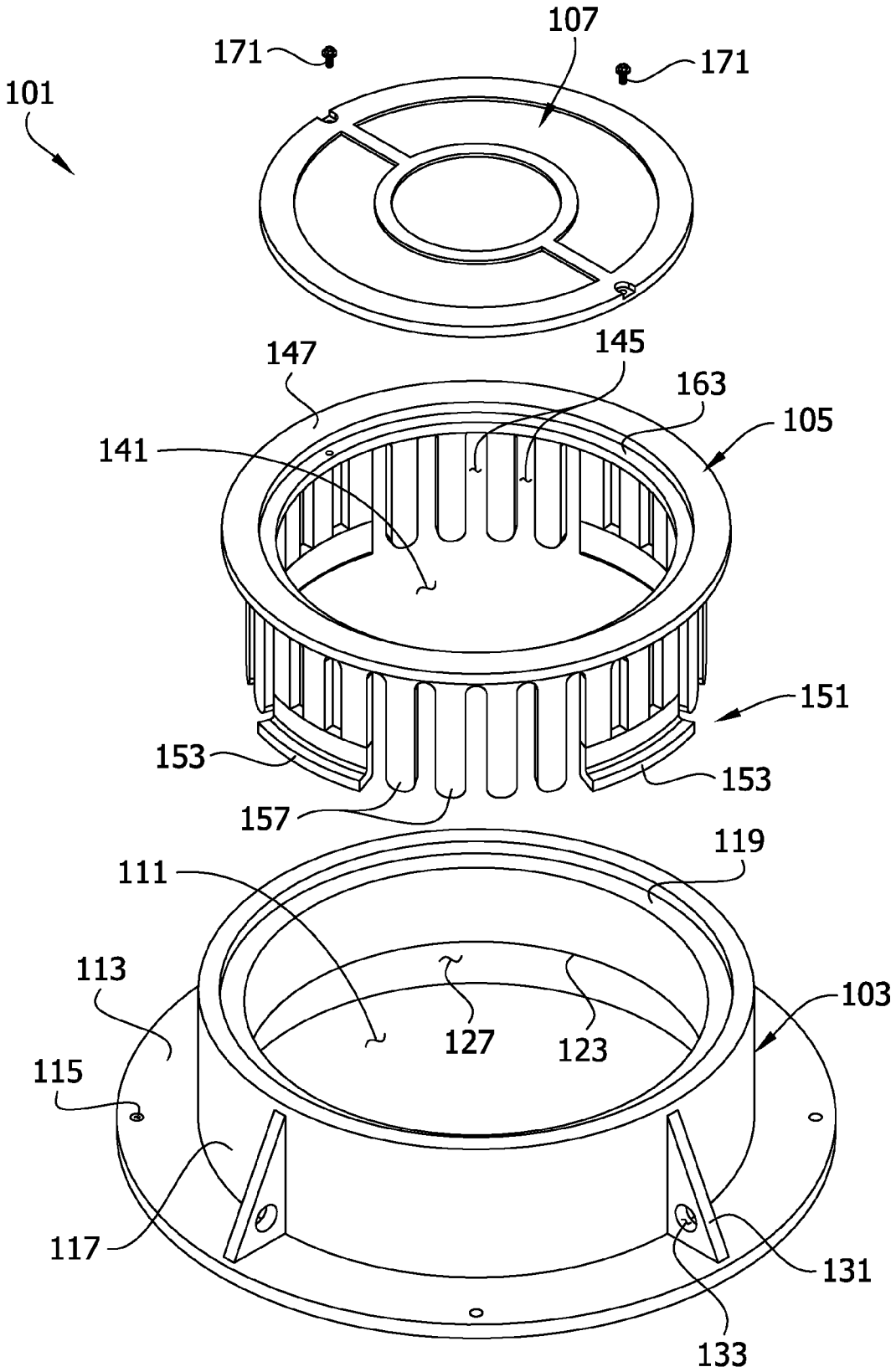
FIG. 2 is an exploded perspective of the manhole closure.

The frame 103 has a frame opening 111, as illustrated in FIG. 2. In the embodiment illustrated in the drawings, the frame 103 includes a plate 113 having a plurality of openings 115 for use securing the frame in position at the top of the underground space. A wall 117 extends generally perpendicularly from an inner margin of the plate 113 and circumscribes the frame opening 111. In the illustrated embodiment, the wall 117 is substantially cylindrical in shape and has a circular cross sectional shape, but the wall can have other shapes within the scope of the invention. The plate 113 suitably extends radially outward from the peripheral wall 117 and from the frame opening 111. In the illustrated embodiment, the plate 113 extends radially outward from a bottom of the wall 117, but it is understood the plate could extend from the top of the wall or an intermediate position between the top and bottom of the wall within the broad scope of the invention. In the illustrated embodiment, the plate 113 has an annular shape and substantially circular inner and outer margins. However, the plate and the peripheral wall extending therefrom can have other shapes without departing from the scope of the invention. A recessed shoulder 119 having an upward facing surface 121 (FIG. 5) extends around the inner margin of the wall 117 at the top of the wall. The frame 103 also has a shoulder 123 having a downward facing surface 125 (FIG. 5) extending around the inner margin of the wall 117 at a position intermediate the top and bottom of the frame. In the illustrated embodiment, the shoulders 119, 123 are combined to form a single thicker portion of the peripheral wall 117 extending between the upward and downward facing surfaces 121, 125, but this is not necessary and the shoulders 119, 123 could instead be spaced from one another within the scope of the invention.

As illustrated in FIG. 1, the frame 103 also has a plurality of lifting lugs 131. The lifting lugs 131 are suitably gussets (e.g., triangular plates) secured to the outer surface of the wall 117 and upper surface of the plate 113. The lifting lugs 131 are suitably oriented at substantially right angles to the plate 113. The lugs 131 are also suitably oriented at substantially right angles to the wall 117. As illustrated in FIG. 1, the lifting lugs 131, plate 113, and wall 117 are mutually orthogonal to one another at the point they intersect. The lifting lugs 131 strengthen the frame 103 by functioning as a brace resisting deformation. Openings 133 are formed in the lugs 131 to facilitate connecting rope, cables, hooks, or the like to the frame 103 to facilitate using the lifting lugs to raise or lower the frame during installation or removal of a manhole system including the frame. The frame 103 is suitably made of metal (e.g., iron, steel, or the like). For example, the frame 103 can be formed as one piece in a casting process.

Figure 3:
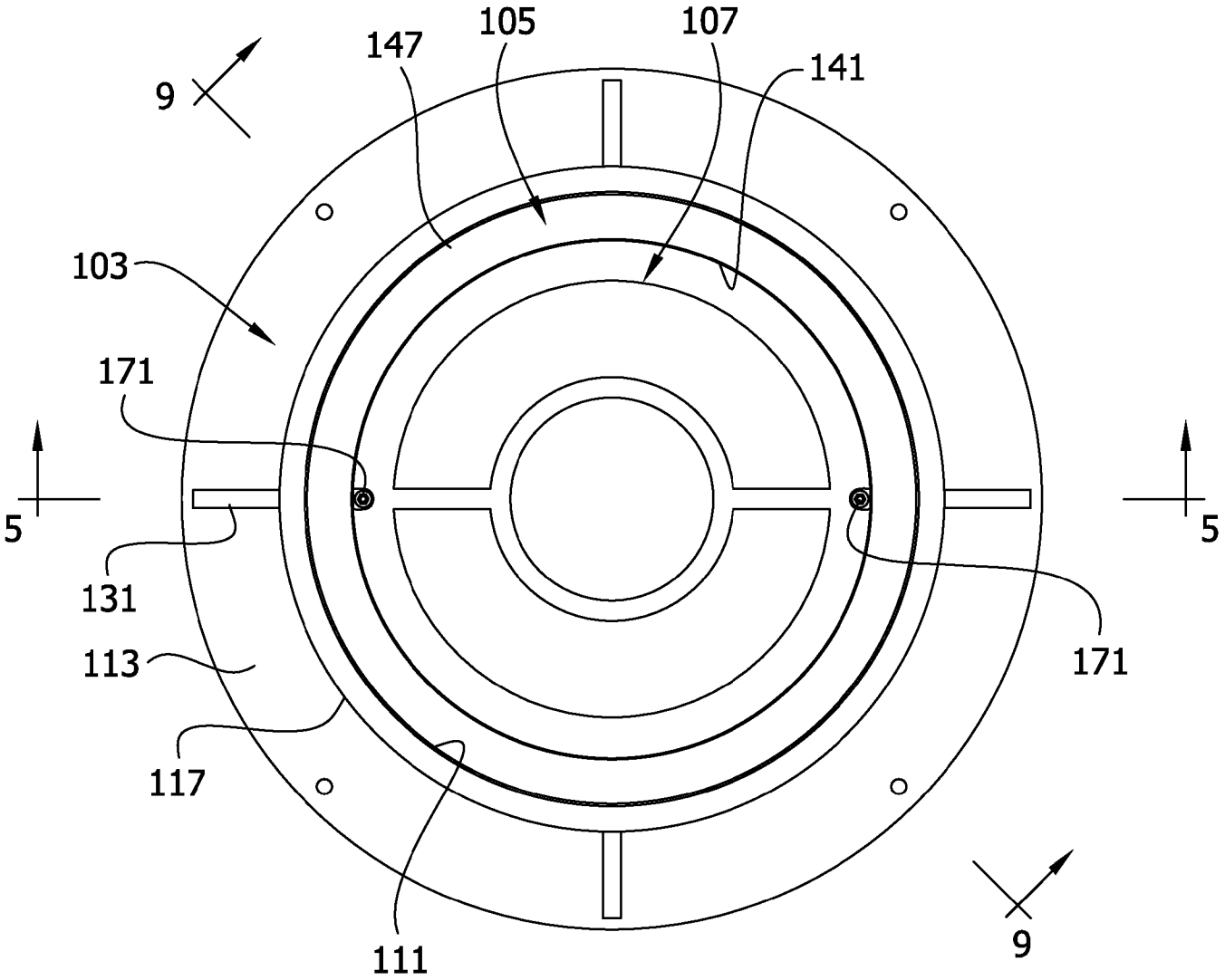
FIG. 3 is a top plan of the manhole closure.
Figure 4:
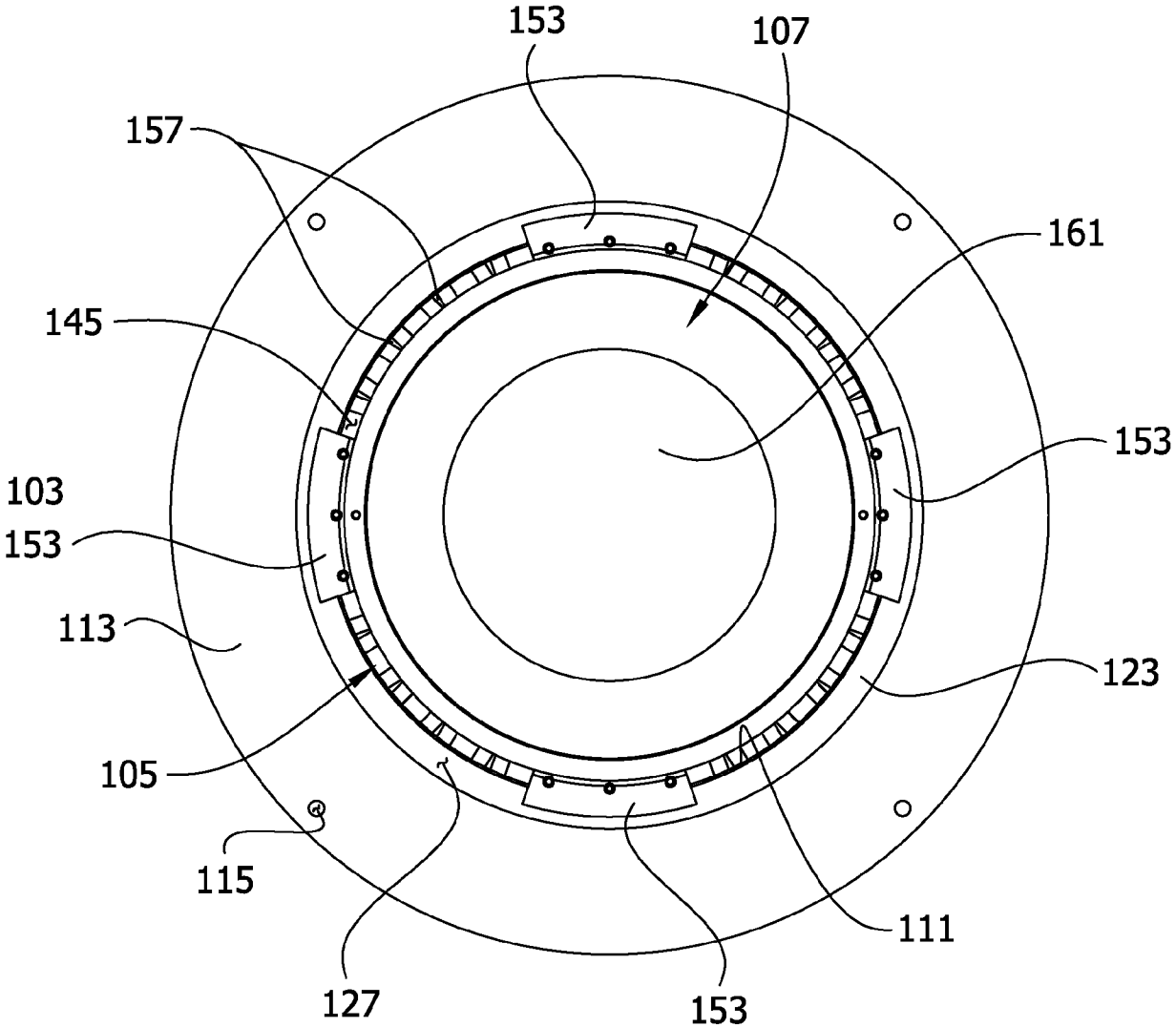
FIG. 4 is a bottom plan of the manhole closure.
Figure 5:
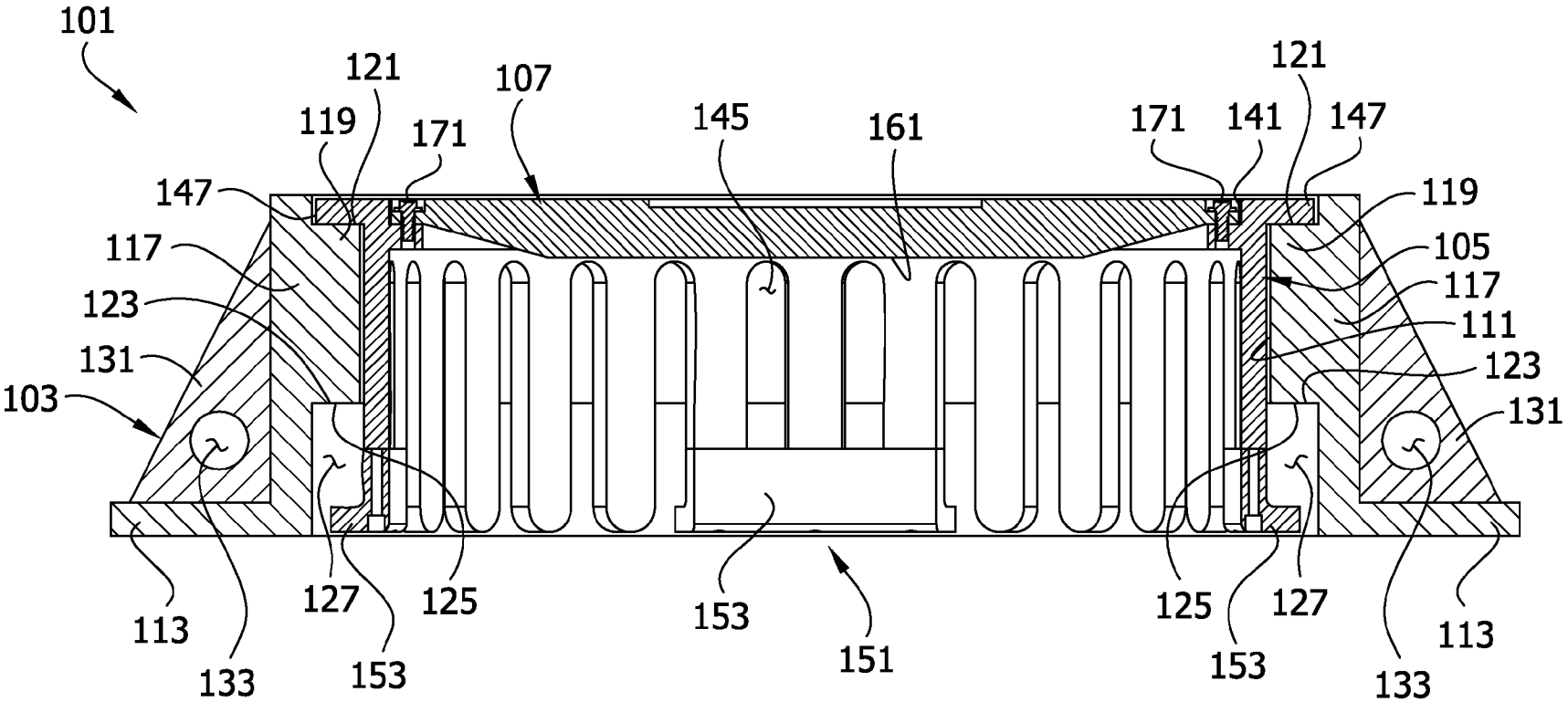
FIG. 5 is a side elevation of a cross section of the manhole closure taken in a plane including line 5-5 on FIG. 3.
Figure 6:
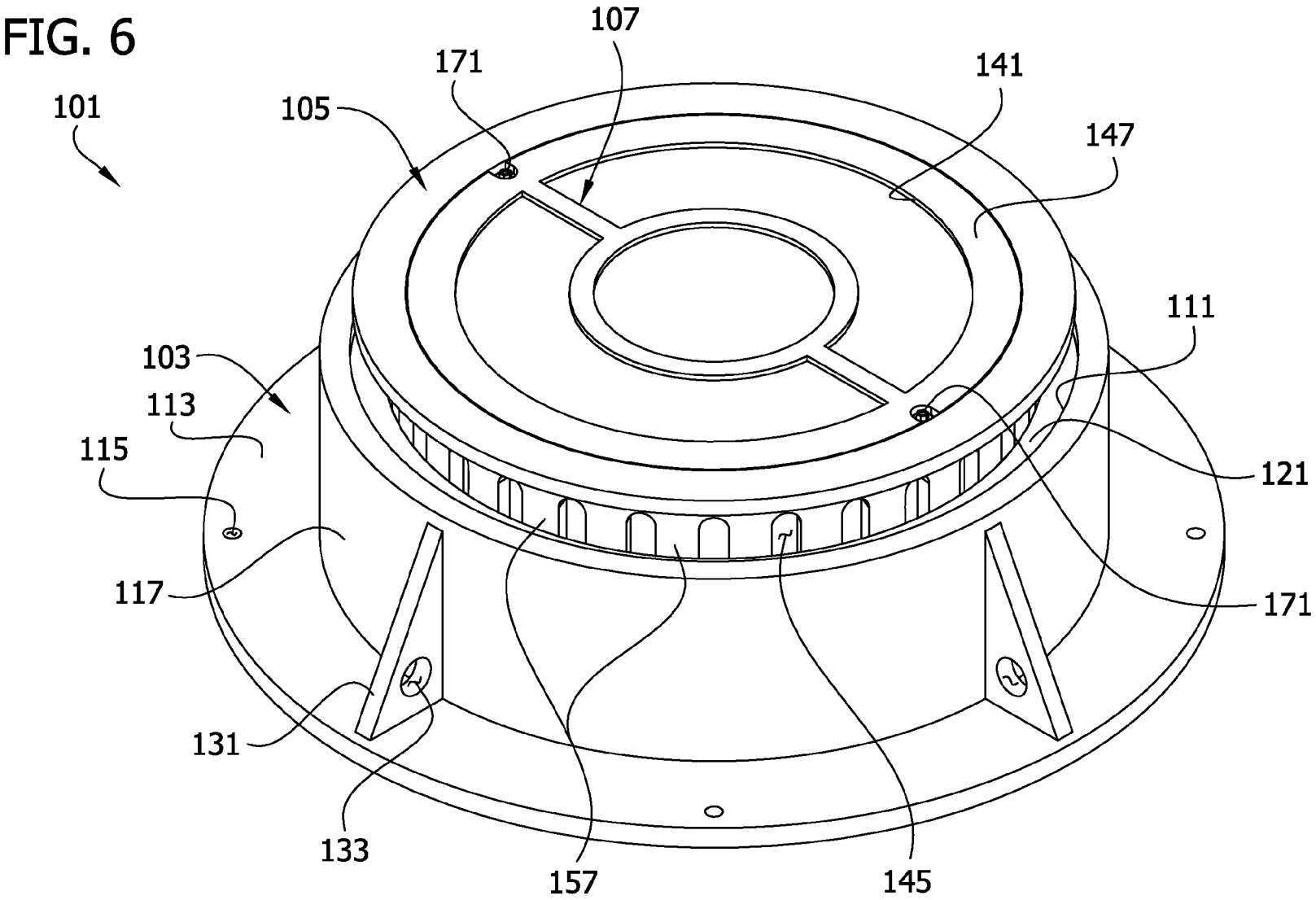
FIG. 6 is a perspective of the manhole closure showing a telescoping sleeve of the closure in an extended position for venting gas from an underground space covered by the closure.
Figure 7:
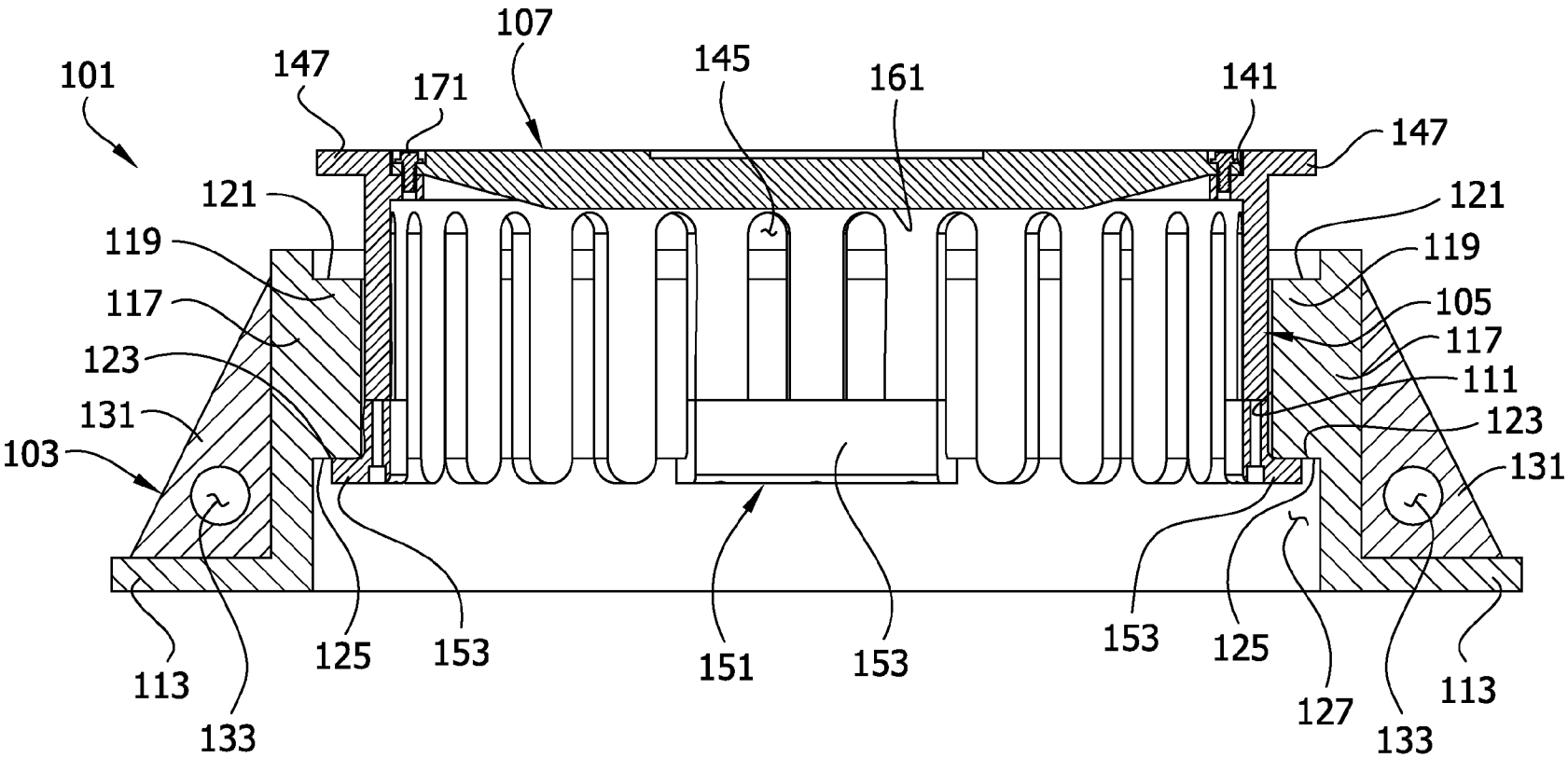
FIG. 7 is a cross section of the manhole closure similar to FIG. 5 but showing the sleeve in the extended position as in FIG. 6.

As illustrated in FIGS. 1, 2, and 5, the sleeve 105 is received in the frame opening 111. For example, the sleeve 105 is suitably mounted in the frame opening 111 for telescoping sliding movement of the sleeve relative to the frame 103 between a retracted position (FIGS. 1, 3, and 5) and an extended position (FIGS. 6 and 7). A low-friction corrosion-resistant coating or liner (not shown) is suitably positioned between the sleeve 105 and the frame 103 to limit build up of corrosion and facilitate sliding movement of the sleeve relative to the frame after many years of non-use. The sleeve 105 has a manhole 141 (FIG. 2) extending axially through the sleeve. The manhole 141 is sized and shaped so when the closure 101 is installed over an underground space, a person can enter the underground space from above through the manhole. The sleeve 105 is suitably substantially cylindrical in shape and suitably has a circular cross sectional shape, although the sleeve can have other shapes within the broad scope of the invention. A plurality of vents 145 extend radially through the sleeve 105 from the inside of the sleeve to the outside of the sleeve. As illustrated in FIG. 2, for example, the vents 145 are notches extending up from a bottom end of the sleeve 105. The vents 145 are suitably spaced circumferentially around the sleeve 105 (e.g., at regular intervals) so gas from the manhole space 141 can be vented through the sleeve in multiple radial directions. The sleeve 105 has a flange 147 (e.g., an annular flange) that extends radially outward at an upper end of the sleeve. The flange 147 is shaped and positioned so it can rest on the upward facing surface 121 of the upper shoulder 119 on the frame 103, as illustrated in FIGS. 1, 3, and 5. A plurality of fingers 157 extend down from the flange 147 and separate the vents 145 from one another. If desired, the vents and fingers can be configured to extend radially through the sleeve from the inside of the sleeve to the outside of the sleeve at one or more angles, as disclosed in U.S. Pat. No. 7,712,995, without departing from the scope of the invention.

The sleeve 105 includes a retaining system 151 adapted to limit movement of the sleeve from the retracted position beyond the extended position. As illustrated in FIGS. 2 and 5, the retaining system 151 can suitably include one or more lugs 153 secured to the sleeve and positioned to engage the downward facing surface 125 on the frame 103 when the sleeve slides to the extended position, as illustrated in FIG. 7.

As illustrated in FIG. 5, the lugs 153 of the illustrated embodiment are suitably formed separately from the rest of the sleeve 105 and attached to the sleeve. For example, the lugs 153 can suitably be attached by one or more fasteners (e.g., bolts) to the lower ends of fingers 157 extending between the vents 145. When attached to the sleeve 105, the lugs 153 extend radially outward from the fingers 157 so the lugs 153 engage the downward facing surface 125 on the frame 103 as the sleeve moves to the extended position to limit movement of the sleeve beyond the extended position. As illustrated in FIG. 2, each lug 153 is attached to the lower ends of three of the fingers 157. The fingers 157 to which the lugs are attached are shorter than the other fingers. The overall combined height of the shorter fingers 157 and lugs 153 is suitably about equal to the height of the other fingers. Those skilled in the art will appreciate that there are various ways to secure the lugs 153 or other suitable structures to the sleeve 105 so the lugs limit movement of the sleeve relative to the frame 103 beyond the extended position without departing from the broad scope of the invention.

The manhole cover 107 is moveable relative to the sleeve 105 between an open position (FIG. 2) and a closed position (FIGS. 1, 3, and 5). When the manhole cover 107 is in the closed position, the manhole cover is supported by a shoulder 163 on the sleeve extending radially inward at the upper end of the sleeve 105. In the closed position, the manhole cover 107 covers the manhole 141 to limit access to the underground space through the manhole while the manhole cover is in the closed position. In the open position, at least a portion of the manhole 141 is not covered by the manhole cover 107 so a person can access the underground space through the manhole. The manhole cover 107 is suitably substantially devoid of explosion mitigation features formed integrally with the manhole cover. The manhole cover suitably has a bottom 161 that is substantially flat (FIGS. 4 and 5) so the manhole cover can slide across pavement on its flat bottom without contacting the pavement with any teeth or other projections that could tend to dig into the pavement. The manhole cover 107 is suitably formed separately from the sleeve 105. For example, the manhole cover 107 can suitably be formed as one piece in a metal casting process. The manhole cover 107 can be identical to a conventional manhole cover from a manhole installation that does not include any explosion mitigation features.

The closure 101 includes one or more locks adapted to releasably secure the manhole cover 107 to the sleeve 105. There are two locks 171 in the illustrated embodiment, but it is understood the number of locks can vary. The locks are suitably adapted so they can be unlocked from a position above the manhole cover 107 while the manhole cover is in the closed position. For example the locks 171 can suitably be hardened steel security bolts having heads that can only be engaged by a tool having a registered pattern (e.g., recessed curvilinear groove) configured to mate with a corresponding pattern in the head of the bolt. This allows people who posses the correct tool to loosen the bolts 171 and remove the manhole cover 107 from the manhole 141. But it makes it difficult for unauthorized people who do not possess the correct tool to loosen the bolts. Suitable security bolts can be purchased commercially from McGard LLC of Orchard Park, N.Y.

The manhole cover 107 and sleeve 105 are configured so the manhole cover can easily be removed from the manhole 141 when the locks are unlocked. For example, the manhole cover 107 and sleeve 103 are suitably configured so the manhole cover can be lifted from the closed position by moving the manhole cover straight upwardly when the locks 171 are unlocked. Moreover, the manhole cover 107 and sleeve 105 are suitably configured so when the locks 171 are unlocked any portion of the perimeter of the manhole cover can be lifted off the sleeve while an opposite portion of the perimeter of the manhole cover remains supported by the sleeve to facilitate moving the manhole cover away from the closed position in any radial direction. There is no skirt or other structure extending down from the manhole cover 107 that impedes removal of the manhole cover from the sleeve 105. There are also no lugs, retainers, or other structures on the manhole cover 107 or sleeve 105 in the illustrated embodiment that require any particular portion of the manhole perimeter to be lifted first when removing the manhole cover from the sleeve. There are also suitably no lugs, retainers, or other structures on the manhole cover 107 or sleeve 105 that require initial movement of the manhole cover away from the sleeve in the radial direction to be in any particular radial direction or range of radial directions. Accordingly, when it is necessary to move the manhole cover 107 to the open position, workers have the same flexibility to choose how to maneuver the manhole cover to take it off the manhole 141 as they would with any conventional manhole cover of the type that provides no protection from having an explosion blow the manhole cover up into the air.

Figure 8:
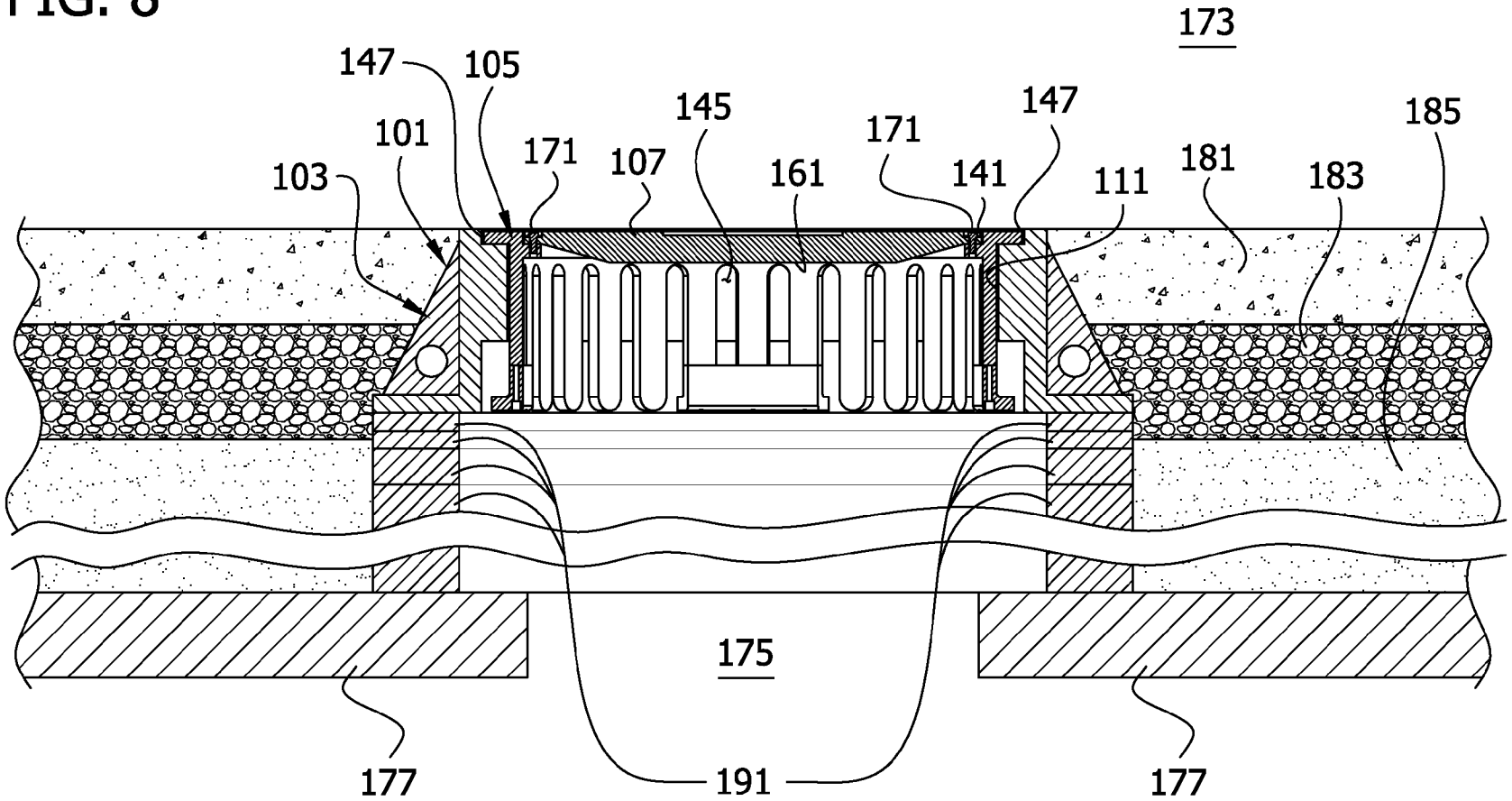
FIG. 8 is a side elevation showing a cross section of the manhole closure taken in a plane including line 5-5 on FIG. 3 and showing the manhole closure installed over an underground space.
Figure 9:
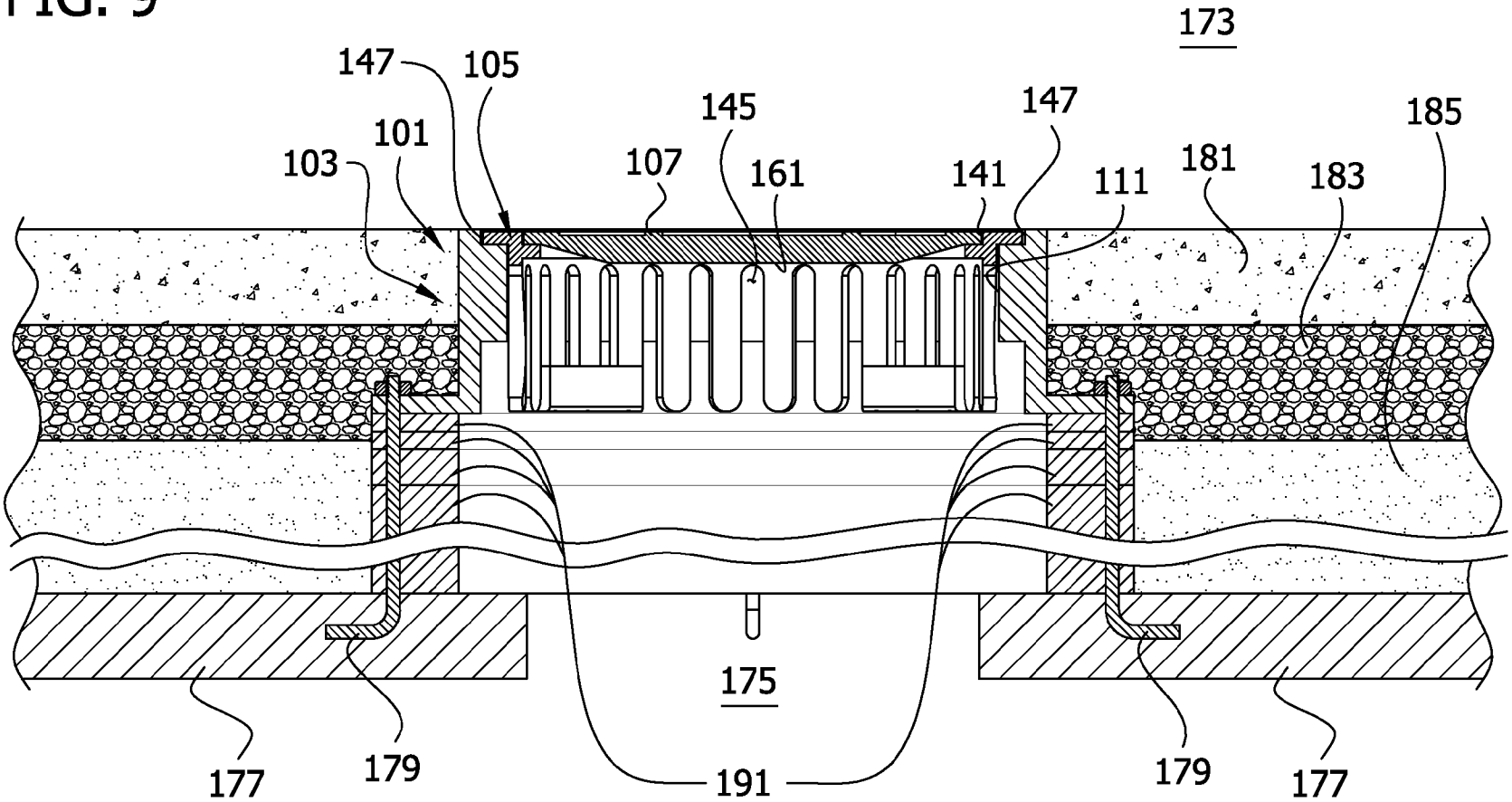
FIG. 9 is a side elevation of the installed manhole cover similar to FIG. 8 showing a cross section of the manhole closure taken in a plane including line 9-9 on FIG. 3.

As illustrated in FIGS. 8 and 9, the closure 101 can be installed in the ground above an underground space 175. For example, the frame 103 of the closure 101 is secured to an anchor 177 (e.g., a ceiling in the underground space) using bolts 179 or other suitable fasteners, as illustrated in FIG. 9. The closure 101 is suitably installed so the upper end of the frame 103 is exposed to the above ground environment 173 and substantially flush with the upper surface of the ground. As illustrated, for example, the upper surface of the ground is formed by the upper surface of pavement 181 covering layers of gravel 183 and dirt 185 and the upper end of the frame 103 is even with the upper surface of pavement. Presence of dirt, gravel, and/or pavement can vary depending on what exists or is added at the installation site during installation of the closure 101 and the installation site illustrated in FIGS. 8 and 9 is just one example of a suitable installation site. The upper surface of the ground can be paved in the case of a street or sidewalk or unpaved (e.g., gravel, dirt, or other earthen substances). One or more risers 191 can be used to maintain spacing between the closure 101 and the ceiling 177 so the upper end of the frame 103 is flush with the upper surface of the ground. It can be desirable to use multiple risers 191 as illustrated because the elevation of the closure can be more easily adjusted if it becomes necessary to raise or lower the closure (e.g., in the event an additional layer of pavement is laid over the existing pavement or in the event the pavement subsides because of settling or other reasons). Also, as illustrated in FIGS. 8 and 9, the closure 101 is designed so the frame 103 is positioned to separate the sleeve 105 and manhole cover 107 from the pavement 181 or other material forming the upper surface of the ground at the installation site. This helps ensure the sleeve 107 can retain the ability to slide up in the event of an explosion even after many years of non-use.

The underground space 175 suitably includes a space under a street or sidewalk.

Figure 10:
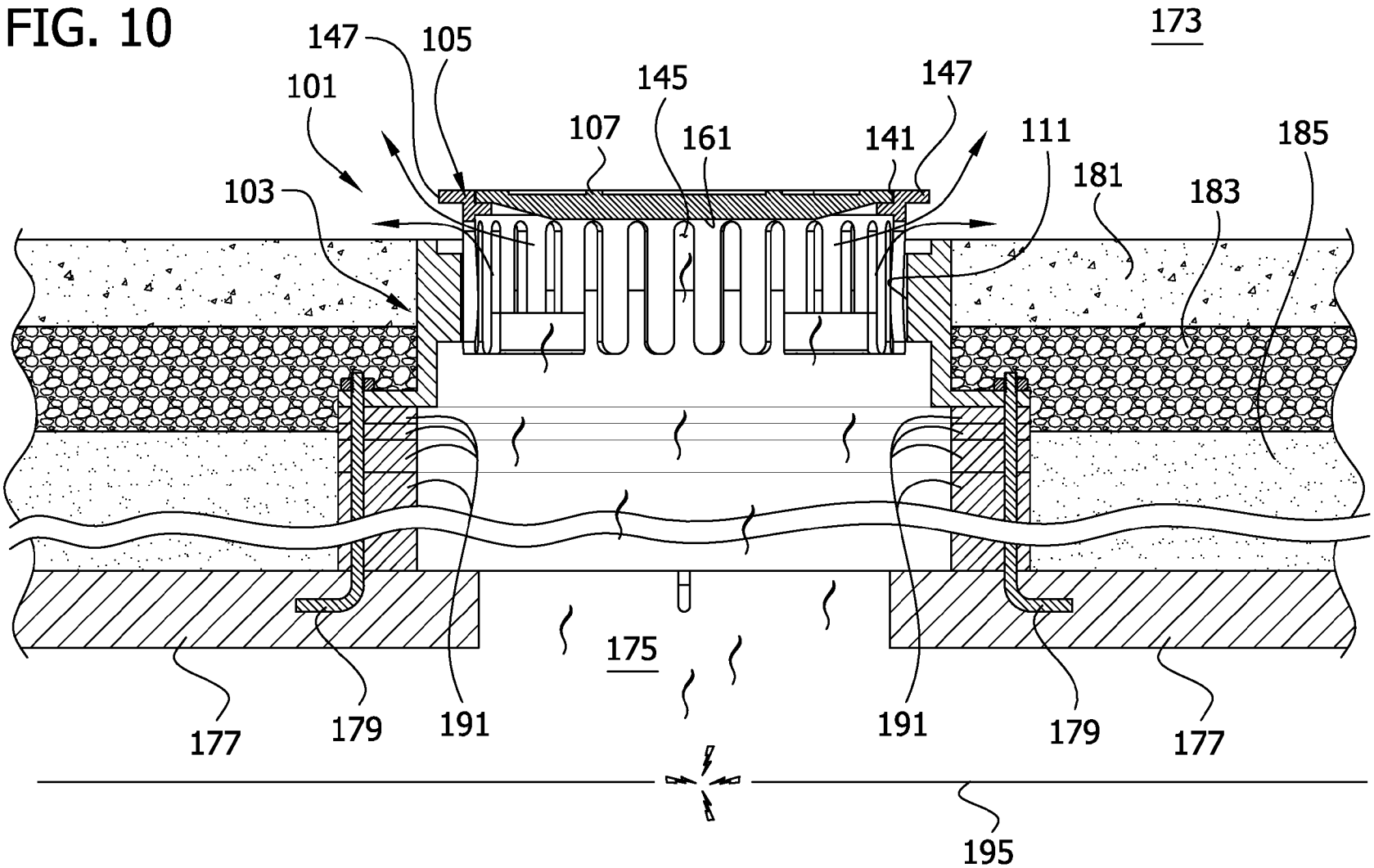
FIG. 10 is a side elevation of the installed manhole cover in cross section similar to FIG. 9 showing venting of gas from the underground space through the manhole closure during an explosion caused by ignition of combustible gas in the underground space.

The underground space 175 can be associated with a sewer or electrical power distribution line. For example, as illustrated in FIG. 10, an electrical power distribution line 195 extends through the underground space 175. The electrical power distribution line 175 can suitably be covered by an electrically insulating covering. Moreover, the underground space 175 can suitably contain or provide access to a joint (not shown) where the ends of two segments of electrical line are joined to form the electrical power distribution line. As those skilled in the art will appreciate, the joint in the electrical line 195 is susceptible to electrical faults. In the event of a faulty electrical power distribution line 195, explosively combustible gases can be produced (e.g., from the insulating covering breaking down with age) and then ignited by a spark from the power distribution line, as illustrated in FIG. 10. Because of the explosive combustion of gases in the underground space 175 there is a rapid increase in pressure in the underground space. Although the drawings illustrate the closure 101 being used over a space containing an electrical distribution line, the closure is suitable for use whenever there is a risk of combustible gases igniting in the underground space regardless of the source of the gas or the cause of ignition.

The sleeve 105 includes a pressure relief system comprising the vents 145 that is adapted to vent gas from the underground space 175 to an above ground environment 173 in the event explosive gas that might accumulate in the underground space is ignited. In particular, the vents 145 in the sleeve are positioned so gas from the underground space can be vented through the vents to the above-ground environment 173 when the sleeve is moved to the extended position (e.g., in response to a force exerted by pressurized gas in the underground space 175 in the event combustible gas is accidentally ignited in the underground space). At least a portion of the vents 145 extend above the frame 103 when the sleeve 105 is in the extended position, as illustrated in FIG. 6. The one or more locks 171 suitably have sufficient collective strength to withstand the force needed to move the sleeve 105 from the retracted position to the extended position so the manhole cover 107 remains substantially in the closed position on the sleeve 105 while the pressurized gas moves the sleeve to the extended position.

The closure 101 is suitably constructed so the sleeve 105 is moveable by gravity from the extended position to the retracted position when there is no pressure difference between the underground space 175 and the above-ground environment 173. This allows the sleeve 105 to fall back to the retracted position after the gas has been vented from the underground space 175. Accordingly, the sleeve and manhole cover can automatically return to their initial positions after the explosion is over, thereby preventing unauthorized access to the underground space after the explosion and avoiding the danger to traffic and/or pedestrians that would result if the sleeve remained in a position that extends above the ground after the explosion. If desired, the closure 101 can include one or more springs or other biasing members (not shown) positioned to bias the sleeve toward the retracted position to help ensure the sleeve returns to the retracted position after an explosion.

Figure 11A:
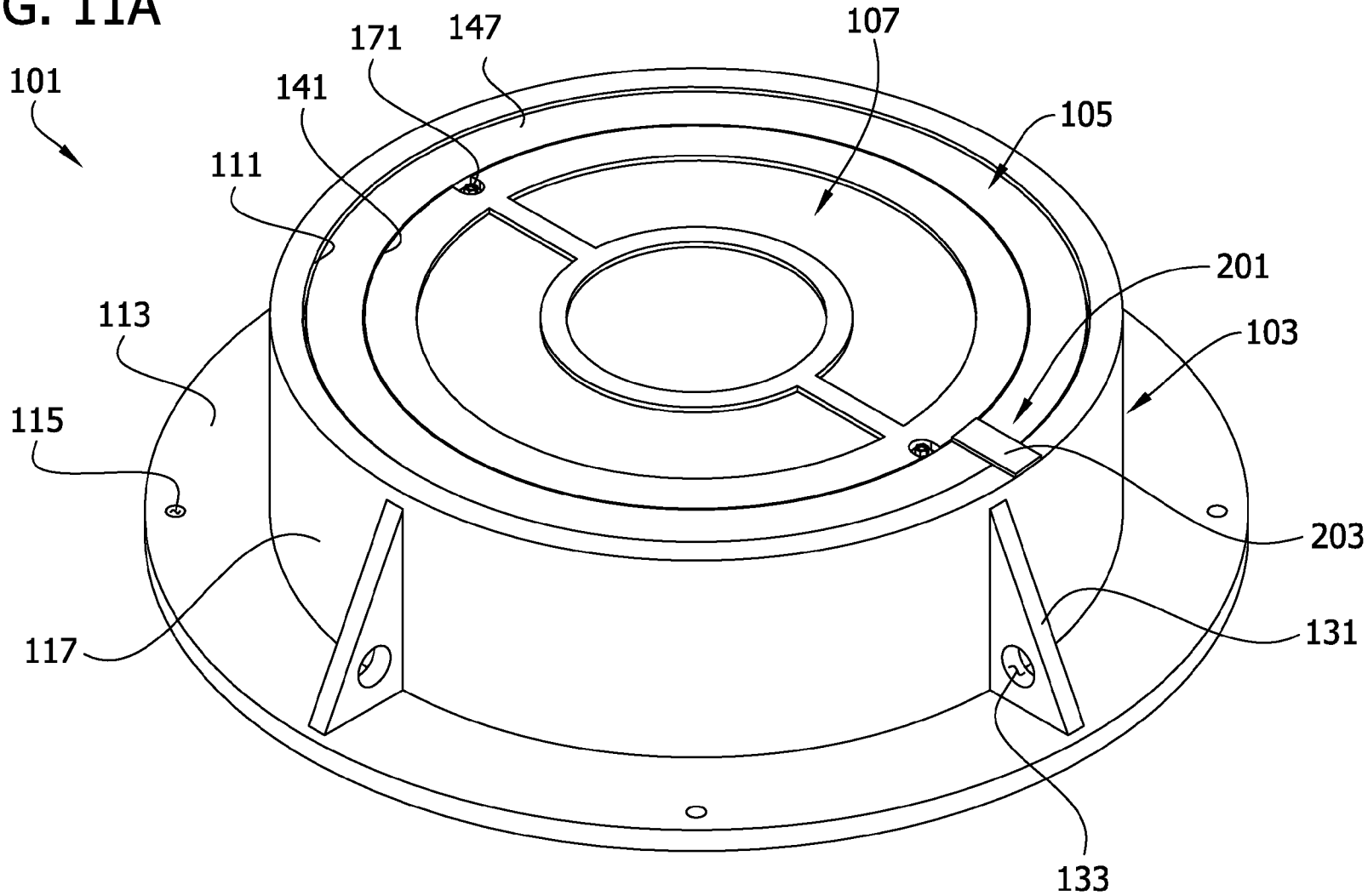
FIGS. 11A-11C illustrate a sequence in which one embodiment an explosion indicator is used to provide a visual indication that an explosion has occurred in the underground space.
Figure 11B:
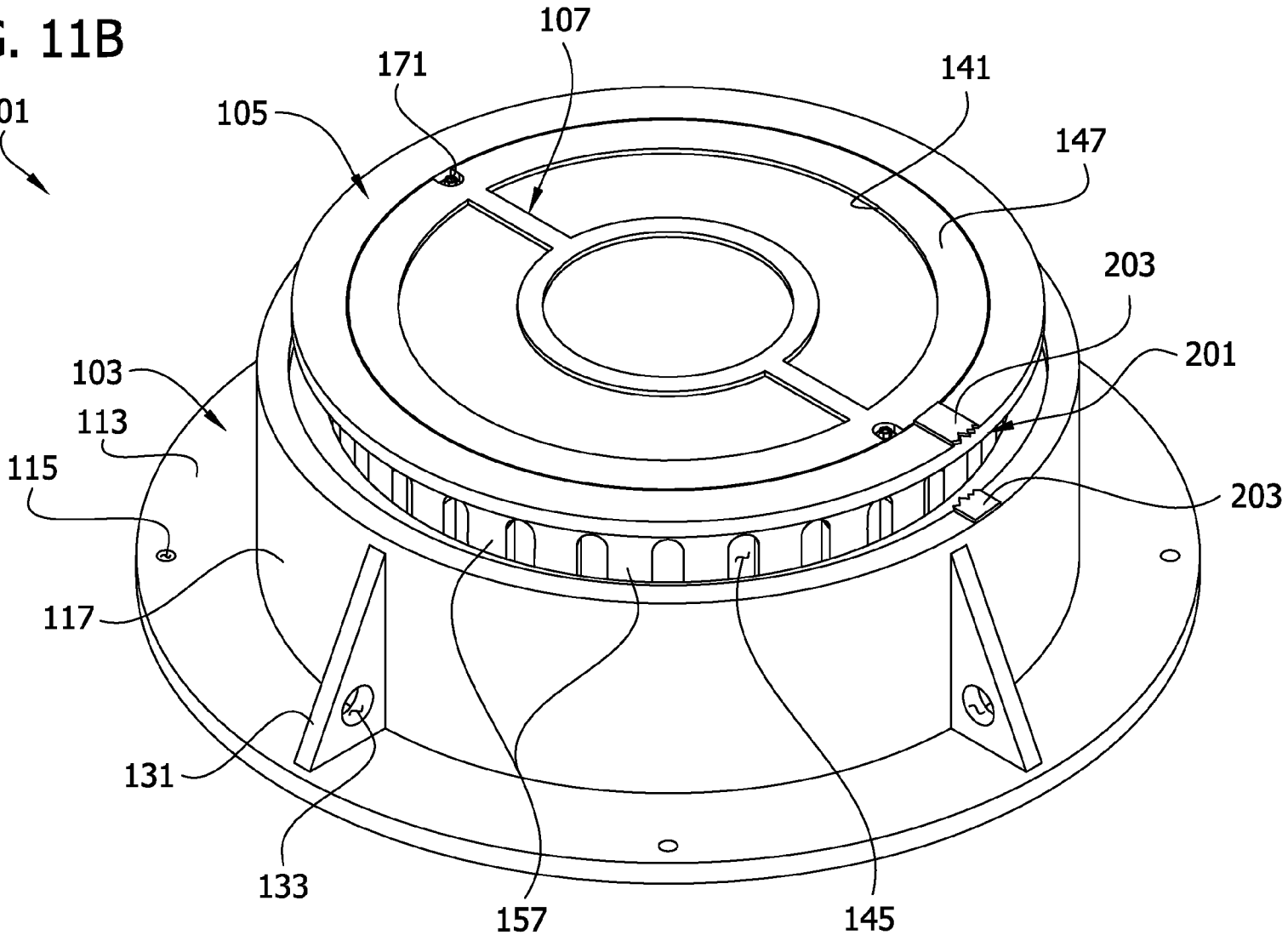
Figure 11C:
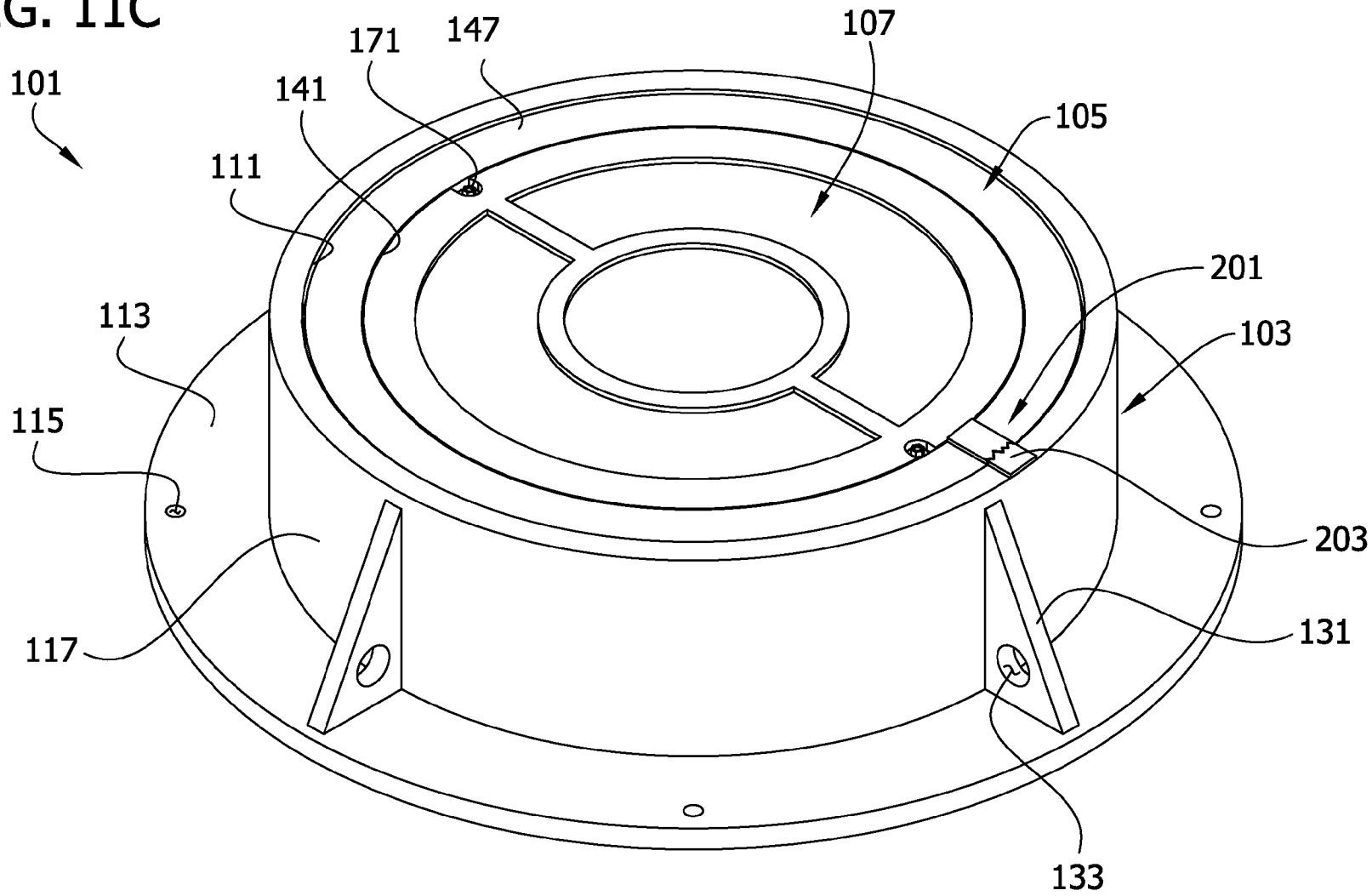

The closure 101 suitably includes an indicator 201 adapted to produce a change in a visual appearance of the system when viewed from the above-ground environment in the event the sleeve is moved to the extended position by pressurized gas in the underground space. As illustrated in FIGS. 11A-11C, a suitable indicator 201 can include a frangible indicator body 203 secured in a position such that movement of the sleeve 105 to the extended position will break the frangible indicator body and such that the frangible indicator body is visible from the above-ground environment. This allows a person to determine if there has been an explosion in the underground space just by looking at the indicator 201 to see whether or not the frangible indicator body 203 is intact. For example, the indicator body 203 can be a thin strip of metal or other material having one end secured to the frame 103 (e.g., by welding, fasteners, etc.) and an opposite end secured to the sleeve 103.

Figure 12A:
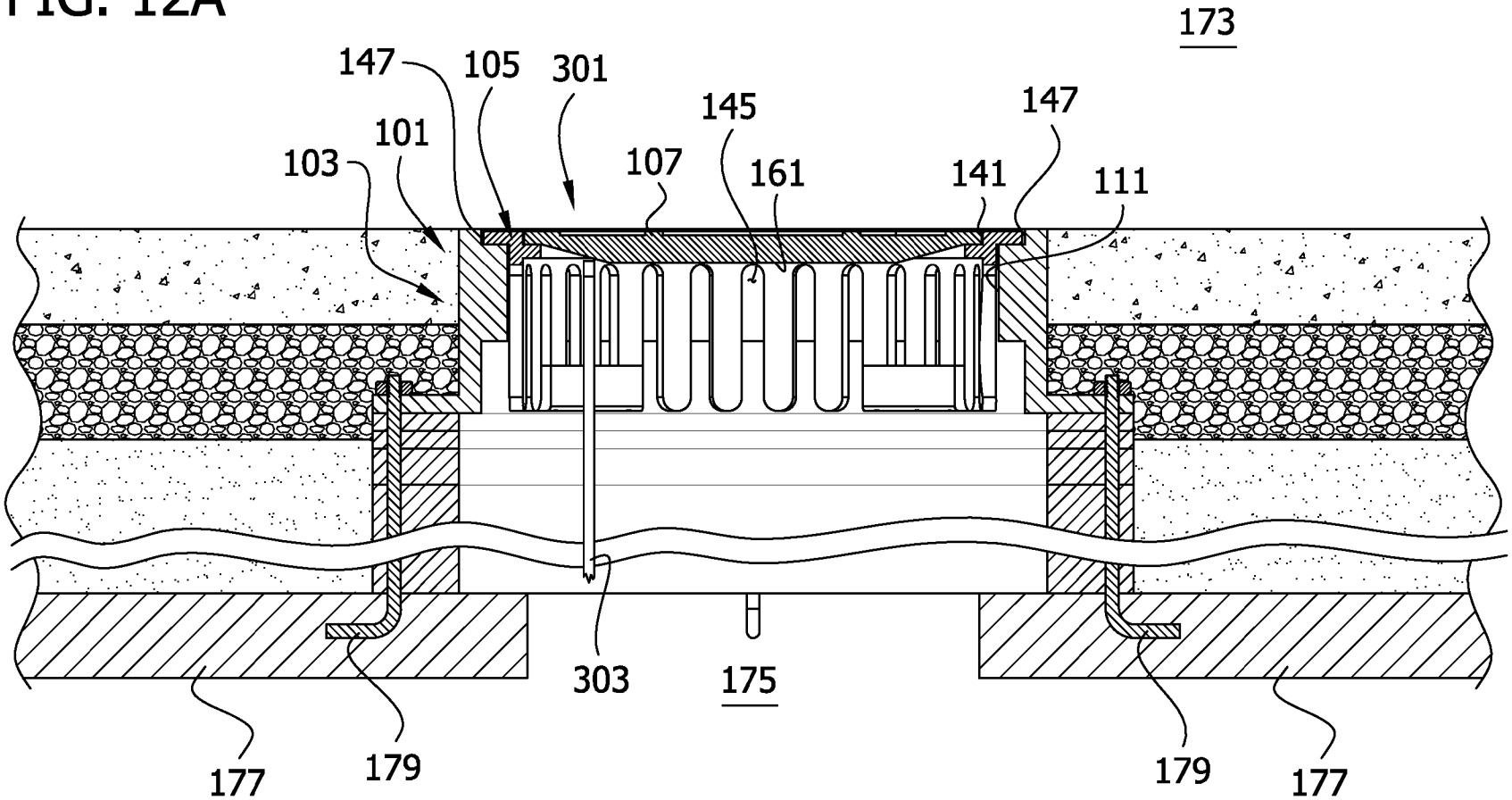
FIGS. 12A-12C illustrate a sequence in which another embodiment of an explosion indicator is used to provide a visual indication that an explosion has occurred in the underground space.
Figure 12B:
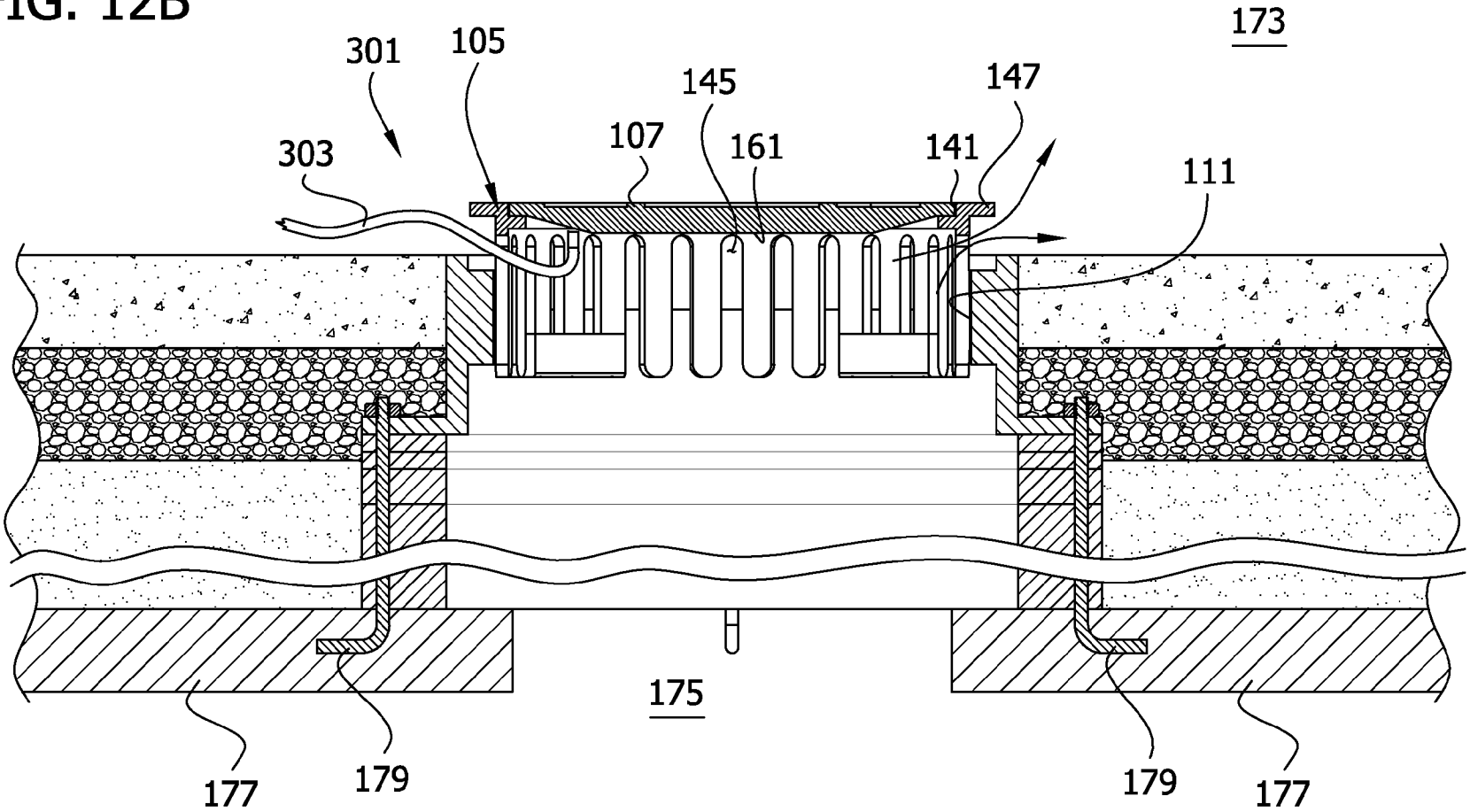
Figure 12C:
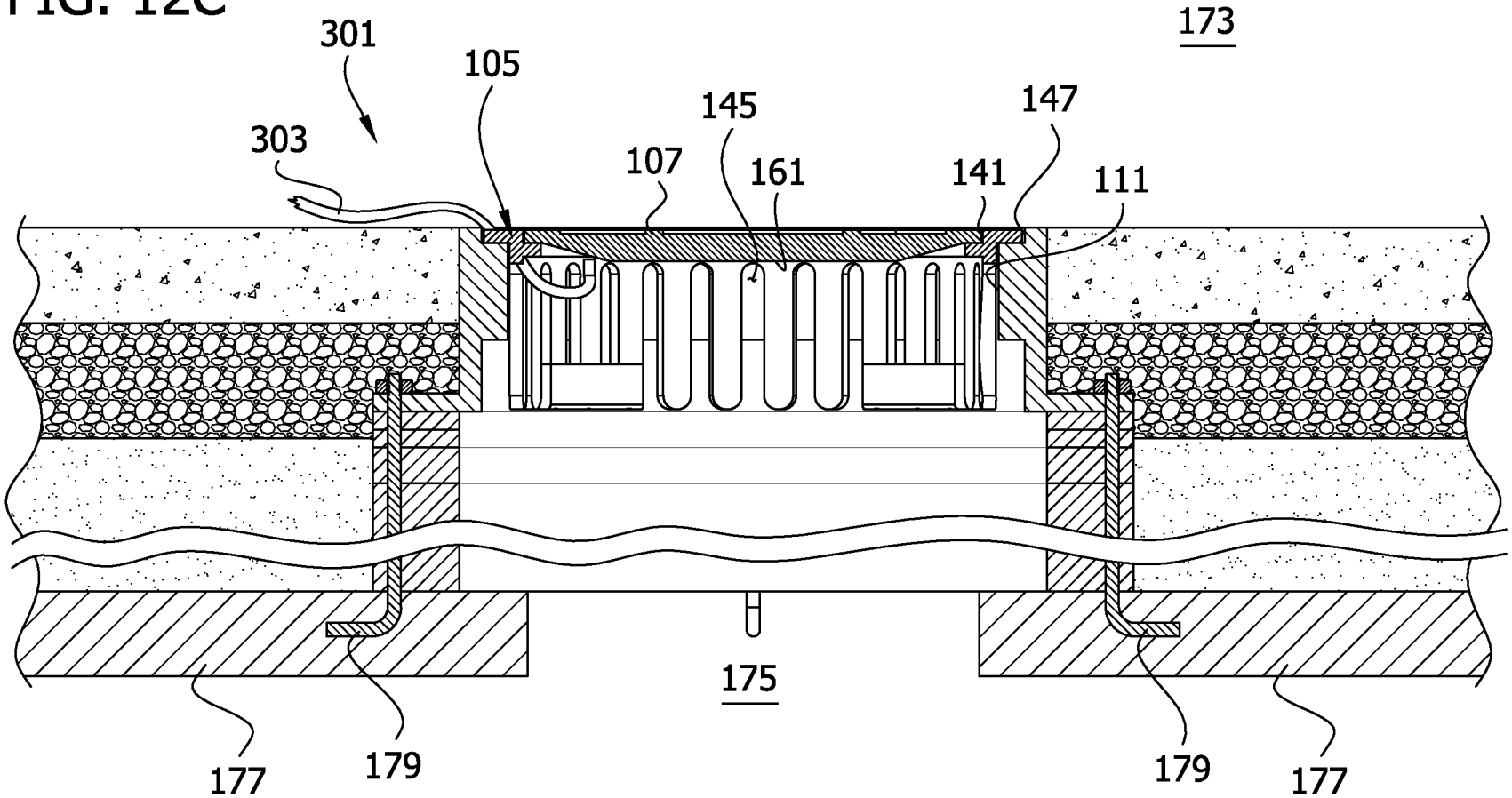

Another example of a suitable indicator 301 is illustrated in FIGS. 12A-12C. The indicator 301 includes an indicator body 303 positioned so flow of the one or more gases during venting of the gases to the above-ground environment 173 moves the indicator body from a first position to a second position different from the first position. The indicator body 303 is visible from the above-ground environment 173 in at least one of the first and second positions. For example, the indicator body 303 can be a strip of flexible lightweight material (e.g., a ribbon) having one end secured inside the underground space 175 (e.g., to the manhole cover 107) and an unattached end opposite the secured end. The flexible strip 303 is positioned so the unattached end will be blown out through one of the vents 145 in the event gas is vented through the vents 145 because of an explosion. Accordingly, the end of the indicator strip 303 is visible from the above ground space 173 after an explosion in the underground space causes venting of gases through the vents and a person can see from looking at the position of the indicator whether or not there has been an explosion in the underground space 175. If desired, the indicator strip can include a telephone number, email address, and/or other contact information advising anyone who sees the indicator, including an untrained member of the public, how to report an explosion to the responsible utility company and/or other appropriate authorities.

It is relatively easy to modify existing manhole installations to convert the existing manhole closure to a closure 101 having explosion mitigation features as described above. For example, in one method an existing manhole installation has a frame defining a manhole opening for accessing an underground space from above and a manhole cover movable between a closed position and an open position. To upgrade the manhole installation a telescoping sleeve (e.g., identical to the sleeve 105 described an illustrated above) is installed in the manhole installation. One option for installing the sleeve is to keep the frame of the existing manhole and mount the sleeve for telescoping movement within the opening of the existing frame. Another option is to replace the frame of the existing manhole installation with a frame that can be substantially identical to the frame 103 described above. In some cases, it may be more desirable to replace the frame even with a larger frame so the manhole opening of the modified installation is about the same size as the manhole opening of the existing installation and/or to facilitate use of the manhole cover from the existing manhole in the modified installation. After the sleeve is installed, a manhole cover (either the same manhole cover that was used in the existing installation or a replacement manhole cover, which may be substantially identical to the manhole cover 107 described above) is placed over the manhole opening defined by the sleeve and one or more locks (e.g., the locks 171 described above) are used to secure the manhole cover to the sleeve.

Although the modified manhole installation produced from this method provides protection against damage produced by explosions, the explosion mitigation features add little or no inconvenience to workers who use the upgraded manhole installation to access the underground space. If they have developed a preference for removing manhole covers by lifting them straight up, they can unlock the manhole cover from the sleeve and then lift the manhole cover straight upwardly until the manhole cover is completely separated from the sleeve to access the underground space in substantially the same manner they would before the upgrade.

If the workers have developed a preference for lifting the manhole cover by only one edge and then pulling the manhole cover by the lifted edge to move the manhole cover in a radial direction to uncover the manhole, they can unlock the manhole cover and then remove it from the manhole in substantially the same manner they would before the upgrade. Moreover, there is no need to lift any particular edge of the manhole first when using this method. The workers can choose to lift the manhole cover by whichever portion of the edge is most convenient. There is no need to lift the manhole in any particular manner to disengage any explosion mitigation features, contrary to what is required in some prior art manhole installations that have explosion mitigation features. Each time workers remove the manhole cover, they can choose to lift the manhole cover by a different portion of the edge.

When introducing elements of the ring binder mechanisms herein, the articles "a", "an", "the" and "said" are intended to mean that there are one or more of the elements. The terms "comprising", "including" and "having" and variations thereof are intended to be inclusive and mean that there may be additional elements other than the listed elements. Moreover, the use of "upward" and "downward" and variations of these terms, or the use of other directional and orientation terms, is made for convenience, and does not require any particular orientation of the components.

As various changes could be made in the above constructions and methods without departing from the scope of the invention, it is intended that all matter contained in the above description and shown in the accompanying drawings shall be interpreted as illustrative and not in a limiting sense.

The invention claimed is:

1. A closure for an underground space, the closure being adapted to limit damage caused by combustion of one or more explosive gases that might accumulate in the underground space, the closure comprising:

a substantially cylindrical sleeve having a plurality of vents extending radially through the sleeve, the sleeve defining a manhole extending axially through the sleeve for providing access to the underground space so a person can enter the underground space through the manhole, and a manhole cover moveable relative to the sleeve and adapted to be moved to a closed position in which the manhole cover is supported by an upper end of the sleeve and covers the manhole to limit access to the underground space through the manhole while the manhole cover is in the closed position, wherein the sleeve has a recessed shoulder at an upper end of the sleeve and the manhole cover is seated on the recessed shoulder in the closed position.

2. A closure as set forth in claim 1 wherein the manhole cover and sleeve are formed separately from one another.

3. A closure as set forth in claim 1 wherein the vents comprise a plurality of notches extending up from a bottom end of the sleeve.

4. A closure as set forth in claim 1 wherein the vents include a plurality of vents spaced circumferentially around the sleeve.

5. A closure as set forth in claim 1 further comprising a low-friction corrosion resistant liner on the outside surface of the sleeve.

6. A closure as set forth in claim 1 further comprising one or more locks adapted to releasably secure the manhole cover to the sleeve, said one or more locks being adapted so they can be unlocked from a position above the manhole cover while the manhole cover is in the closed position, the manhole cover and sleeve being configured so the manhole cover can be lifted from the closed position by moving the manhole cover straight upwardly when the one or more locks are unlocked.

7. A closure as set forth in claim 1 further comprising one or more locks operable to releasably secure the manhole cover to the sleeve, said one or more locks being adapted so they can be unlocked from a position above the manhole cover while the manhole cover is in the closed position, the manhole cover and sleeve being configured so when the locks are unlocked any portion of the perimeter of the manhole cover can be lifted off the sleeve while an opposite portion of the perimeter of the manhole cover remains supported by the sleeve to facilitate moving the manhole cover away from the closed position in any radial direction.

8. A closure as set forth in claim 1 wherein the manhole cover has a bottom that is substantially flat.

9. A closure as set forth in claim 1 further comprising a frame for securing the closure to a riser connecting an underground space to an above-ground environment, the frame having a frame opening, wherein the sleeve is configured to be slideably received in the frame opening for telescoping movement of the sleeve relative to the frame.

10. A closure as set forth in claim 9 further comprising a retainer adapted to limit movement of the sleeve from the retracted position beyond the extended position.

11. A closure as set forth in claim 1 further comprising:

(i) a frame for securing the closure to a riser connecting an underground space to an above-ground environment, the frame having a frame opening, wherein the sleeve is configured to be slideably received in the frame opening for telescoping movement of the sleeve relative to the frame; and (ii) one or more locks operable to releasably secure the manhole cover to the sleeve, said one or more locks being adapted so they can be unlocked from a position above the manhole cover while the manhole cover is in the closed position, the one or more locks having sufficient collective strength to withstand a force that is sufficient to move the sleeve in an upward direction relative to the frame against the force of gravity to an elevation at which the vents extend above a top of the frame for venting gas through the vents.

12. A closure as set forth in claim 1 further comprising:

(i) a frame for securing the closure to a riser connecting an underground space to an above-ground environment, the frame having a frame opening, wherein the sleeve is configured to be slideably received in the frame opening for telescoping movement of the sleeve relative to the frame between a retracted position in which the vents do not extend above a top of the frame and an extended position in which the vents extend above the top of the frame for venting gas through the vents; and (ii) a biasing member biasing the sleeve toward the retracted position.

13. A closure as set forth in claim 1 wherein the sleeve has a flange at its upper end extending radially outward relative to the manhole.

14. A closure as set forth claim 13 further comprising one or more retaining lugs, wherein the sleeve and retaining lugs are adapted for attachment of the retaining lugs to the sleeve at an end of the sleeve opposite the flange.

15. A closure as set forth in claim 1 wherein the manhole cover is substantially free of explosion mitigation features.

16. A closure as set forth in claim 1 wherein the manhole cover consists essentially of a unitary structure formed as one piece in a metal casting process.

17. A closure as set forth in claim 16 wherein the manhole cover has a substantially flat bottom.

18. A closure as set forth in claim 1 further comprising one or more security bolts adapted to releasably lock the manhole cover to the sleeve, said one or more security bolts being adapted so they can be unlocked from a position above the manhole cover while the manhole cover is in the closed position, the manhole cover and sleeve being configured so the manhole cover can be lifted from the closed position and separated from the sleeve by moving the manhole cover straight upwardly when the one or more security bolts are unlocked.

19. A closure as set forth in claim 18 wherein the manhole cover and sleeve are configured so when the one or more security bolts are unlocked any portion of the perimeter of the manhole cover can be lifted off the sleeve while an opposite portion of the perimeter of the manhole cover remains supported by the sleeve to facilitate moving the manhole cover away from the closed position in any radial direction.

20. A closure as set forth in claim 18 wherein the manhole cover has bottom that is substantially flat.

21. A closure for an underground space, the closure comprising:

a substantially cylindrical sleeve having a plurality of vents extending radially through the sleeve, the sleeve defining a manhole extending axially through the sleeve for providing access to the underground space so a person can enter the underground space through the manhole, and a manhole cover moveable relative to the sleeve and adapted to be moved to a closed position in which the manhole cover is supported by an upper end of the sleeve and covers the manhole to limit access to the underground space through the manhole while the manhole cover is in the closed position, wherein the manhole cover has a substantially flat bottom and the closure is adapted to limit damage caused by combustion of one or more explosive gases that might accumulate in the underground space.

22. A closure as set forth in claim 21 wherein the manhole cover does not have any skirt on its bottom.

* * * * *